73-151 SR
2/23/82 OR 4,316,386

United States Patent [19]
Kerekes

[11] 4,316,386
[45] Feb. 23, 1982

[54] FLUID PRESSURE MEASURING APPARATUS FOR INCORPORATION INTO A PIPELINE RISING FROM A WELL

[75] Inventor: Ferenc Kerekes, Ahlten, Fed. Rep. of Germany

[73] Assignee: Preussag Aktiengesellschaft, Fed. Rep. of Germany

[21] Appl. No.: 131,447

[22] Filed: Mar. 18, 1980

[30] Foreign Application Priority Data

Apr. 6, 1979 [DE] Fed. Rep. of Germany ..... 2913896

[51] Int. Cl.[3] ..... E21B 47/06
[52] U.S. Cl. ..... 73/151; 166/332
[58] Field of Search ..... 73/151, 155; 166/250, 166/316, 318, 332

[56] References Cited

U.S. PATENT DOCUMENTS 3,422,896 1/1969 Nutter ..... 73/155 X
4,159,643 7/1979 Watkins ..... 73/155
4,204,426 5/1980 Patton et al. ..... 73/151

*Primary Examiner*—Jerry W. Myracle
*Attorney, Agent, or Firm*—Allegretti, Newitt, Witcoff & McAndrews

[57] ABSTRACT

A fluid-pressure measuring means for a well, which is adapted to be coupled into adjacent sections of a delivery or riser pipe in the area of the environment in which pressure is to be measured, having two concentric pipes, the inner one being in communication with the environment through a conduit extending through the annular space between the pipes, a valve within the inner pipe to close the conduit, and a pressure sensing device that can be lowered into the inner pipe to open the valve and close off a chamber within the inner pipe to sense the environmental pressure then prevailing in the chamber. The valve is spring biased to closed position and opens under the force of the weight of the pressure sensing device.

10 Claims, 5 Drawing Figures

FLUID PRESSURE MEASURING APPARATUS FOR INCORPORATION INTO A PIPELINE RISING FROM A WELL

BACKGROUND OF THE INVENTION

The invention relates to a pipe arrangement for incorporation into a delivery pipeline extending from a borehole delivering liquid from a well by means of an immersion pump.

Delivery boreholes in wells containing mineral deposits generally have a protective casing comprising a filter or perforated pipe in the lower part and a riser pipe in the upper part. A delivery pipe inside the casing has an immersion pump connected to the lower end thereof and installed in the borehole for delivery of the liquid to the surface. In such boreholes the monitoring of the behavior of the deposit surrounding the bore and hydraulic pressures in the strata during the entire delivery time is of great importance, since this, together with other delivery and deposit data afford a control of the output of a deposit.

Previously, in the case of such boreholes, a direct measurement of the hydraulic pressure in the well, as well as of the pressure build-up on stoppage of the delivery, has not been possible because pressure-measuring devices cannot be lowered in the annular space between casing pipe and delivery pipe. Lowering a measuring device in the delivery pipe is of no use, because the measured pressures are affected by the potential energy of the fluid column standing in the delivery pipe when, as is usual, a check valve is provided which prevents the dropping of the fluid column upon operation stoppage. Even if the check valve were omitted, this measurement would give information on pressure data in the area of the inlet opening of the immersion pump only after shutting down the immersion pump. Electrical measuring methods, which are useful at shallow depths within rough limits of accuracy, are not technically feasible for great depths and high pressures.

SUMMARY OF THE INVENTION

The object of the invention is to make possible measurement of enclosure and hydraulic pressures of a mineral deposit in a new way from inside the delivery pipe.

This object is achieved by providing a pipe assembly, to be "spliced" into the delivery pipe, having a chamber open at the top, and which communicates through a passage with the delivery pipe and through a conduit with the environment surrounding the delivery pipe. The conduit is closed by a valve, and by providing a pressure-sensing device which can be lowered from above into the chamber, said device in its lowered position, actuates the valve to keep it open while the measurement is being taken. The pressure-sensing device also closes off the chamber to seal it against any pressure other than that of the environment outside the delivery pipe.

The invention is thus based on the novel idea of being able to measure the pressure outside a delivery pipe, hence within the borehole itself, from within the delivery pipe. For this purpose a conduit is provided in the wall of the pipe assembly, comprising a segment of the delivery pipe, through which conduit the pressure outside the pipe can penetrate into its interior, more specifically into the chamber which is sealed by a pressure-sensing device let down into the chamber, the sensing device by its own weight opening a valve which normally keeps the conduit closed. In this way the exterior pressure can reach the interior of the pipe assembly chamber, where in accordance with the invention, the pressure-sensing device is located. The device then measures the ambient pressure in the chamber, which is in communication with the delivery pipe and the borehole, and records the sensed-measurement values on a sheet in diagram form or transmits it over a wire, as desired.

This arrangement makes possible an accurate pressure measurement, whether the pump is operating or not. Furthermore, the measurement is not dependent on the delivery rate at the time of measurement. Since the lowering of the measuring instrument through the delivery pipe is possible without any problems, great depths are also attainable.

The chamber is advantageously formed of a pipe section arranged concentrically within the pipe assembly and closed at the bottom, the outside diameter of which is smaller than the inside diameter of the delivery pipe section. The annular space between the chamber pipe section and the delivery pipe section constitutes a passage for the stream flowing through the delivery pipe, it being advantageous for the delivery pipe section in the area of the chamber to have a larger diameter than the remainder of the pipe, so that no constriction of the delivery cross-section occurs because of the chamber.

THE DRAWING

Additional details and advantages of the invention will be seen from the following description of several embodiments of the invention:

DETAILED DESCRIPTION

Figure 1:
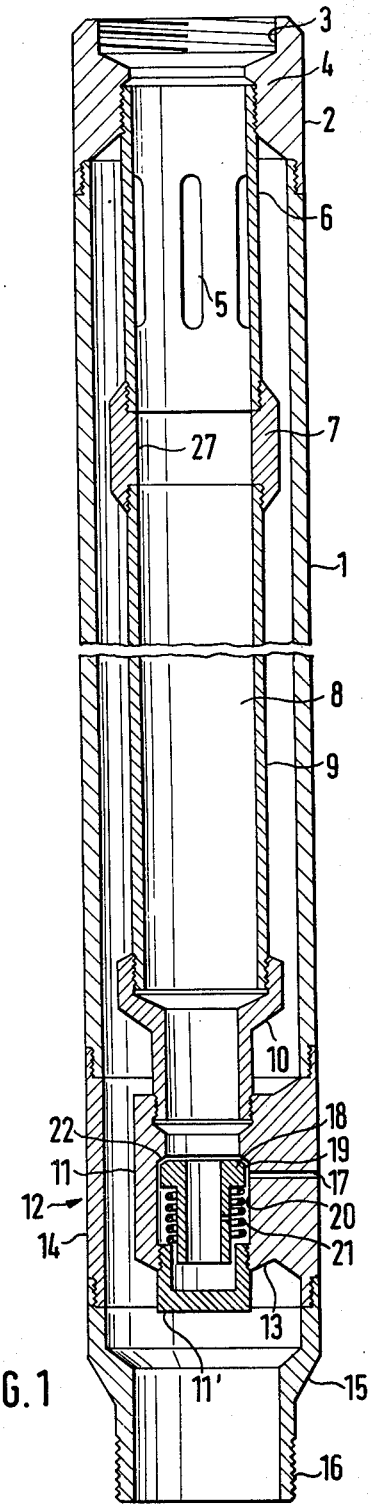
FIG. 1 is a longitudinal sectional view through a pressure-measuring pipe installation for incorporation into a delivery pipe without the measuring device.

FIG. 1 shows a pipe assembly which has a delivery pipe 1, to the top of which a sleeve 2 is screwed, the inside threads 3 of which couple the assembly to a section of a regular riser or delivery pipe. The sleeve has an inside flange 4, into which is screwed a nipple 6 having circumferentially-spaced slots 5. A coupling 7, is screwed to the other end of nipple 6 and to a pipe section 9 forming a chamber 8. The lower end of pipe 9 is screwed via a connecting piece 10 into the inner tube 11 of a coupling 12. Tube 11 is connected by a spider comprising radial webs 13 to the external tube 14 of the coupling. A reducer 15 couples the pipe assembly to an adjacent section of the delivery pipe. The inside tube 11 is closed off by a cap 11'.

The pipe assembly is screwed into adjoining sections of a delivery pipe above the immersion pump, and becomes in effect a section of the delivery pipe. The delivery pipe is lowered into the borehole or casing pipe to a depth where the environment to be measured surrounds the pipe assembly.

Within the web 13 there is a radially-disposed conduit 17 which leads into the chamber 8 which is defined at its lower end by the interior of the inner tube 11. Within the inner tube 11 there is located a valve body 18 having two spaced O-ring seals 19 which slide on an inner wall 20 of the inner tube 11. The valve body is urged upward to closed position by a compression spring 21 against a shoulder stop 22.

The location of, and the spacing between the seals 19 and the rest position of the valve body 18, determined by the stop 22, cause the valve body 18 in conjunction with the seals 19 to seal off the outlet of the conduit 17. This valve position is shown in FIG. 1. In this condition, the chamber 8 is not in communication with the environment surrounding the delivery pipe 1 and therefore the pressure therein is not the pressure prevailing around the delivery pipe 1. The liquid stream flowing through the assembly moves freely through the open space in an axial direction past the webs 13 and around the inner tube 11 of the coupling, through passages 5 of the pipe section 6 into chamber 8 and then upward into the connected pipe section.

Figure 2:
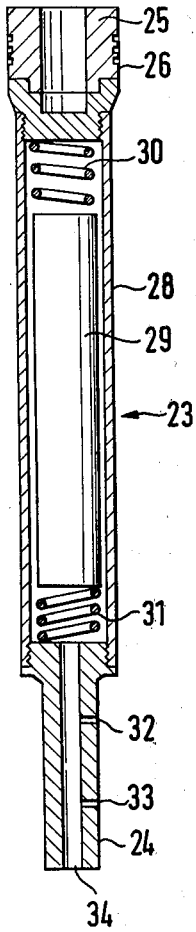
FIG. 2 is a similar view of a measuring device for insertion into the pipe installation shown in FIG. 1.

With the pipe assembly as shown in FIG. 1, a probe or pressure-sensing device 23 as shown in FIG. 2 is represented in the same relative position in which it is situated after being lowered from the ground surface, down the delivery pipe and into the chamber 8. In this position, the weight of the sensing device 23 presses the valve body 18 against the force of the compression spring 21 to the point where the upper of the two seals 19 is located below the outlet of conduit 17. The chamber 8, therefore, becomes connected with the environment by way of the conduit 17. With the sensing device in this position, the chamber 8 is closed at the top by piston 25, whose outer wall 26 forms a tight seal with the smooth inner band 27 of coupling 7.

Between the lower end 24 of the sensing device and the piston 25 there extends a sheath 28 which surrounds protectively on all sides a pressure-measuring element 29 which is held elastically in vertical attitude by shock-absorbing compression springs 30 and 31. The pressure-measuring element 29 is thus protected against shocks when the whole sensing device 23 impacts after a fast drop. Element 28 need not be a tube since other connector shapes will serve to connect parts 25 and 24 while protecting the element 29. The lower end 24 of the sensing instrument 23 contains channels 32, 33 and 34 to provide good communication to the pressure-measuring element 29. The construction of the pressure-measuring element is optional and well-known and therefore does not require further description.

Figure 3:
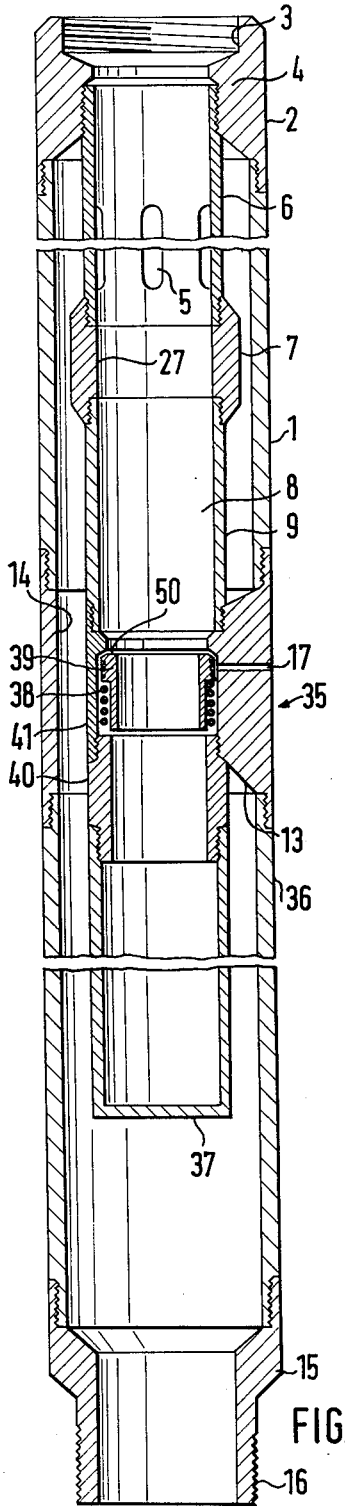
FIG. 3 is a similar view of a second embodiment of the invention showing the pipe installation without the measuring device.

The embodiment of the invention illustrated in FIG. 3 corresponds essentially to the form of the invention shown in FIG. 1, except the double sleeve coupling 35 is installed in the central area of the chamber 8. Corresponding parts are designated by the same reference numbers. Because of the central location of the coupling 35, an additional pipe section 36 is provided between coupling 35 and the reducer 15. Also cap 37, in contrast to the cap 11 in FIG. 1, extends farther downward. The abutment for a compression spring 38 for a valve body 39 is the upper end of a sleeve 40 which is screwed into an inner tube 41 of the double sleeve coupling 35. The inside diameters of the cylindrical valve body 39, of the sleeve 40 connected to it and of the cap 37 are greater than in the case of the embodiment of FIG. 1, so that the pressure-measuring element 42 of the sensing device shown in FIG. 4 can extend through the valve body 39 down into the cap 37.

Figure 4:
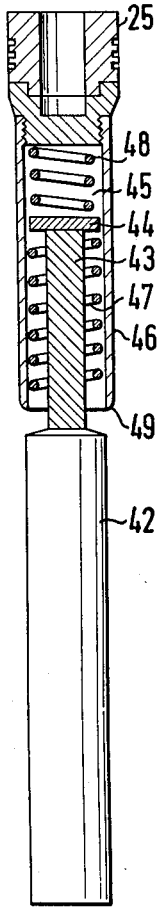
FIG. 4 is a similar view of a device for insertion into the pipe installation of FIG. 3.

The pressure-measuring element 42 shown in FIG. 4 has a rod 43 terminating in a flange 44 movable in a cylindrical sheath 46. Compression springs 47 and 48 contact opposed sides of the flange 44. The compression spring 48, like the compression spring 30 in FIG. 2, pushes against the piston 25 which piston in the lowered position of the sensing device is located within the coupling 7 and seals off the chamber 8.

When the sensing means shown in FIG. 4 is lowered in the apparatus shown in FIG. 3, the bottom edge 49 of the sheath 46 whose diameter is greater than that of the measuring element 42, contacts the upper edge 50 of the valve body 39 and pushes it downward against the force of the compression spring 39, so that the outlet opening of the conduit 17 is connected with the chamber 8 and the pressure-measuring element 42 is exposed to the environmental pressure to be measured.

Figure 5:
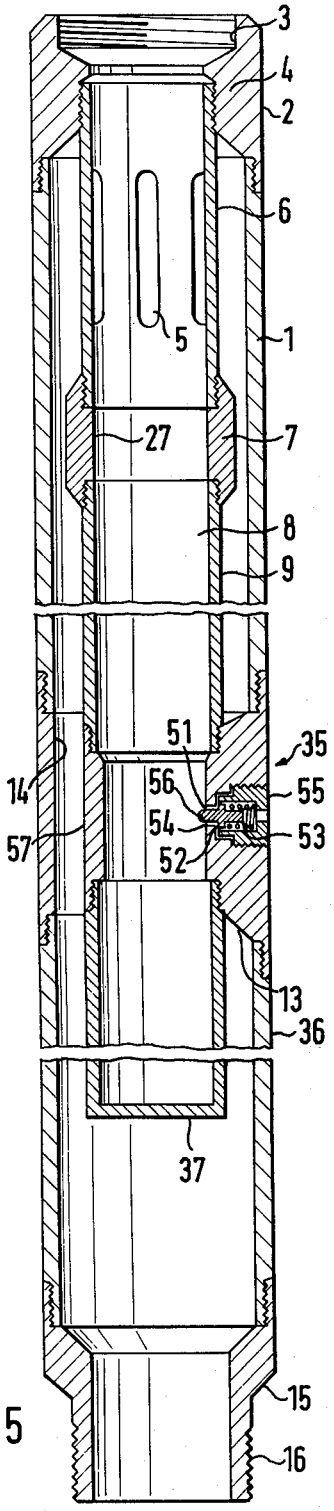
FIG. 5 is a similar view of a third embodiment of the invention showing a pipe installation in which the measuring device shown in FIG. 4 is usable.

FIG. 5 shows a further embodiment of the invention which corresponds essentially to that of FIG. 3 and which is also designed for the use of the same sensing device shown in FIG. 4. However, in the embodiment of FIG. 5, the valve is made differently, being located here in the area of the horizontally-disposed conduit 54 through web 13 connecting the chamber 8 with the environment outside pipe 1. The valve consists of valve body 51, whose flange 52, under the force of a compression spring 53, rests against the seat formed by the edges of conduit 54. The valve body 51 has a nose 56 which projects into the interior of an inner sleeve 57 of the double sleeve coupling 35. The valve body 51 is thus pushed outwards by the measuring element 42 when it is let down, causing the valve to be opened.

The compression springs 30, 31 and 47, 48 have the function of taking up shocks upon impacts of the sensing device and of protecting the measuring element 29 or 42.

What is claimed is:

1. Means for measuring fluid pressure surrounding a delivery pipe disposed in a well comprising a first pipe section connected at its lower end to said delivery pipe, a second pipe section disposed concentrically within said first pipe section and defining a chamber having an open upper end, a passage through the wall of said second pipe section permitting fluid flow from the annular space around said chamber to said delivery pipe through said open upper end, a radially-disposed conduit connecting said chamber with the space outside said delivery pipe, valve means within said chamber for closing off said conduit, and a pressure sensing device adapted to slide into said chamber through said open end, the lower end of said device serving to open said valve, the upper end of said device sealing off said chamber at a point below said passage so that the interior of the chamber is in communication only with the space outside the delivery pipe through said conduit.

2. The measuring means of claim 1 which includes a fitting screwed on to the upper end of said first pipe section, said fitting having an inwardly-extending threaded flange into which said second pipe section is screwed.

3. The measuring means of claim 1 in which said second pipe section includes an internal band having a smooth surface which mates with said upper end of said pressure-sensing device for sealing the chamber below said passage.

4. The measuring means of claim 1 in which said first pipe section includes a coupling having an inner cylindrical tube spaced from the inner wall of the coupling by means of a web, and said tube forms an extension of said second pipe section and said chamber, said conduit being formed in said web, and said valve means being mounted for axial movement within said tube.

5. The measuring means of claim 4 in which said valve means in closed position is spring biased upwardly against a stop.

6. The measuring means of claim 5 in which said biasing spring will compress under the weight of said pressure-sensing device to open the valve.

7. The measuring device of claim 1 in which said pressure-sensing device has a pressure-measuring element, a tubular sheath surrounding said element and spring means mounting said element within said tubular sheath.

8. The measuring means of claim 7 in which the interior of said tubular sheath is in communication with the interior of said chamber.

9. The measuring means of claim 1 in which said pressure-sensing device has a pressure-measuring element having a flanged rod extending from the upper end thereof, a tubular sheath surrounding said rod, and spring means disposed within said tubular sheath for cushioning said element.

10. The measuring means of claim 1 in which said first pipe section has an enlarged diameter in the area of said chamber.

* * * * *